US012635740B2

(12) United States Patent
Thompson

(10) Patent No.: US 12,635,740 B2
(45) Date of Patent: May 26, 2026

(54) UNITARY GARMENT TO FACILITATE LAVATORY ACCESS

(71) Applicant: Sabrina Thompson, Baltimore, MD (US)

(72) Inventor: Sabrina Thompson, Baltimore, MD (US)

(73) Assignee: Sabrina N. Thompson, Baltimore, MD (US)

( * ) Notice: Subject to any disclaimer, the term of this patent is extended or adjusted under 35 U.S.C. 154(b) by 23 days.

(21) Appl. No.: 18/543,304

(22) Filed: Dec. 18, 2023

(65) Prior Publication Data

US 2024/0197000 A1 Jun. 20, 2024

Related U.S. Application Data

(60) Provisional application No. 63/433,213, filed on Dec. 16, 2022.

(51) Int. Cl.
*A41D 1/06* (2006.01)

(52) U.S. Cl.
CPC ..... *A41D 1/065* (2013.01); *A41D 2400/44* (2013.01)

(58) Field of Classification Search
CPC .... A41D 1/065; A41D 2200/10; A41B 9/005; A41B 9/007; A41B 9/008
See application file for complete search history.

(56) References Cited

U.S. PATENT DOCUMENTS 1,092,809 A * 4/1914 Davison et al. ..... A41B 9/08 2/78.2
1,151,610 A * 8/1915 Powell ..... A41D 13/02 2/70
1,284,391 A * 11/1918 Luckett ..... A41B 9/08 2/78.2
1,326,536 A * 12/1919 Slattery ..... A41D 13/02 2/79
1,341,224 A * 5/1920 Campbell ..... A41D 13/02 2/79
D56,331 S * 10/1920 Armstrong ..... D2/744
1,392,303 A * 10/1921 Custer ..... A41D 13/02 2/78.2
1,398,443 A * 11/1921 Pendergrass ..... A41D 13/02 D2/743
1,405,963 A * 2/1922 Atkinson ..... A41B 9/08 2/78.2
1,659,451 A * 2/1928 Sweeney ..... A41D 13/02 2/79

(Continued)

*Primary Examiner* — Alissa L Hoey

(57) ABSTRACT

A unitary jumpsuit that facilitates lavatory access using a two-way tail-to-tail zipper in the front that subdivides the upper torso section and extends down below the waist to the crotch area, and a lapped two-way head-to-head zipper in the rear that extends along a seam from below the knees upward along each leg, upward and converging above the buttocks below the waist. The rear zipper releases a drop-panel. A wearer can fully open and/or close the drop-panel in one easy motion by zipping/unzipping each side of the rear double-pull zipper, using both hands to simultaneously pull both zipper-pulls across the waist and down each leg. The wider deeper drop-panel allows easier lavatory access for men and women and provides more comprehensive access for feminine sanitary needs.

2 Claims, 4 Drawing Sheets

(56) References Cited

U.S. PATENT DOCUMENTS 1,691,957 A * 11/1928 Blanshan ..... A41D 13/02 2/79
1,783,538 A * 12/1930 Herskowitz ..... A41D 13/02 D2/743
1,785,581 A * 12/1930 Fellroth ..... A41D 13/02 2/79
1,902,634 A * 3/1933 Gross ..... A41D 10/00 2/83
1,976,126 A * 10/1934 Hickerson ..... A41B 9/08 D2/744
2,228,624 A * 1/1941 Leopold ..... A41D 1/06 2/235
2,263,146 A * 11/1941 Smith ..... A41D 13/02 2/79
2,333,240 A * 11/1943 Florian ..... A41D 1/06 2/70
2,357,532 A * 9/1944 Menzin ..... A41D 1/06 D2/743
2,521,767 A * 9/1950 Zecha ..... A41D 13/02 2/84
2,849,717 A * 9/1958 Klotz ..... A41D 13/02 2/79
3,711,865 A * 1/1973 Schifman ..... A41D 13/02 2/79
3,949,427 A * 4/1976 Sampey ..... A41D 13/02 2/79
3,994,026 A * 11/1976 Sampey ..... A41D 13/02 D2/743
4,447,911 A * 5/1984 Marcellaro ..... A41D 13/02 2/79
4,457,025 A * 7/1984 Meryash ..... A41D 13/02 2/79
4,535,480 A 8/1985 Kunieda
4,578,828 A * 4/1986 Smith, Sr. ..... A41D 1/065 2/408
4,604,761 A * 8/1986 Wright ..... A41D 1/06 D2/742
4,835,795 A * 6/1989 Lonon ..... A41B 9/08 2/408
4,941,209 A * 7/1990 George ..... A41D 13/02 2/77
5,010,595 A * 4/1991 Stradley ..... A41D 1/06 2/234
5,014,356 A 5/1991 Tomasi Dubois
5,636,387 A * 6/1997 Lundy ..... A61F 5/0096 2/406
5,642,526 A * 7/1997 Thompson ..... A41D 13/02 2/DIG. 1
5,896,581 A * 4/1999 Wong ..... A41D 13/02 2/78.2
5,983,401 A * 11/1999 Ohara ..... A41D 13/02 2/234
6,477,711 B1 * 11/2002 Freeman ..... A41D 13/02 2/78.2
D505,535 S * 5/2005 Kern ..... D2/742
6,941,584 B1 * 9/2005 Matthews ..... A41D 13/02 2/234
6,944,883 B1 9/2005 Cuaz
7,257,846 B2 * 8/2007 Paciorkowski ..... A41D 31/14 2/69
D550,428 S * 9/2007 Kern ..... D2/742
8,256,023 B2 * 9/2012 Park ..... A41D 13/02 2/69
8,332,966 B1 * 12/2012 Countryman ..... A41D 1/065 2/234
8,479,320 B2 * 7/2013 Swafford ..... A41D 1/065 2/78.2
8,898,813 B2 * 12/2014 Davis ..... A41D 13/02 2/79
9,119,428 B2 * 9/2015 Kuelker ..... A41D 13/02
9,247,774 B2 * 2/2016 Davis ..... A41D 13/02
10,004,649 B2 * 6/2018 Kuo ..... A61F 13/49006
10,765,156 B2 * 9/2020 Myerscough ..... A41B 9/00
2004/0261156 A1 * 12/2004 Lewis ..... A41D 1/06 2/227
2005/0091728 A1 * 5/2005 Rocha ..... A41D 1/06 2/227
2006/0277649 A1 * 12/2006 Smith ..... A41D 1/088 2/69
2011/0004982 A1 * 1/2011 Henningsen ..... A41D 13/02 2/243.1
2014/0304894 A1 * 10/2014 Bishop ..... A41D 1/06 2/236
2015/0121603 A1 * 5/2015 Lang ..... A41B 13/005 2/80
2017/0181483 A1 * 6/2017 Eisenhuth ..... A41D 1/08
2017/0273371 A1 * 9/2017 Turner ..... A41D 13/02
2017/0325526 A1 * 11/2017 Barnabe ..... A41D 1/06
2018/0027896 A1 * 2/2018 Stobar ..... A41B 13/005
2018/0042310 A1 * 2/2018 Mortimer ..... A41B 13/005
2018/0206561 A1 * 7/2018 Moran ..... A41D 1/065
2019/0125008 A1 * 5/2019 King ..... A41D 7/008
2020/0383404 A1 * 12/2020 Naismith ..... A41D 13/1263
2021/0345692 A1 * 11/2021 Xu ..... A41D 1/06
2024/0292913 A1 * 9/2024 Turner ..... A41D 1/06
2024/0381954 A1 * 11/2024 Christensen ..... A41D 31/18

* cited by examiner

UNITARY GARMENT TO FACILITATE LAVATORY ACCESS

CROSS-REFERENCE TO RELATED APPLICATION(S)

The present application derives priority from U.S. Provisional Patent Application 63/433,213 filed 16 Dec. 2022.

BACKGROUND OF THE INVENTION

1. Field of the Invention

The present invention relates generally to working apparel and, in particular, a one-piece jumpsuit that facilitates lavatory access for urination and other sanitary needs.

2. Description of the Background

There are many varieties of flight suits for pilots, astronauts and the like. However, most, if not all are single-piece designs for the male body. Such flight suits do not properly fit females in the hip, thigh, or breast areas. Furthermore, traditional flight suits present an inconvenience for women because they need to remove the entire flight suit to use a toilet.

There have been prior efforts to incorporate a drop-seat into a jumpsuit for ease of access. For example, U.S. Pat. No. 4,535,480 shows a jumpsuit with a rudimentary horizontal opening in the back. However, the opening is difficult to access and does not allow the flap to drop low enough. Consequently, when sitting on a toilet with the drop seat flap released, the wearer is forced to sit with their upper body leaning forward in a squat.

U.S. Pat. No. 5,014,356 shows a jumpsuit with an elasticized waistband and side tabs having fasteners that, when fastened, secure the dropseat in closed position with the appearance of a normal jumpsuit. Despite improved access, the dropseat is not fully-peripherally attached when closed and interrupts the one-piece elasticity of the jumpsuit.

U.S. Pat. No. 6,944,883 shows a jumpsuit specifically tailored to the anatomical needs of a woman, with an elongated circumferential zipper to undo the dropseat. The zipper is a better solution but in this case is located below the waistline and above the hips, and extends at least 270° around the jumpsuit. This design does not allow the dropseat flap to drop low enough to accommodate wearers who are a bit curvier and have buttocks that extrude beyond their waist/backs. Because the drop seat flap does not fall close to knee-height it is not practical to use for sanitary purposes after toilet usage (urinating), especially for women who need to remove and replace tampons and reach their underwear to remove and replace sanitary napkins without making a mess or staining their garment.

What is needed is a wider and deeper drop seat opening that extends past the knees with a dual-zipper closure accompanied by a two-way zipper in the front of the flight suit that extends below the crotch area which allows easy access and options for men and women, and especially women to be comfortable and carefully take care of their feminine sanitary needs.

SUMMARY OF THE INVENTION

According to an embodiment of the invention, a unitary jumpsuit is described comprising a one-piece garment for covering the torso, arms and legs. The jumpsuit has an upper torso section with opposing arms, and adjustable cuff straps at both wrists and shoulders. The upper torso section is attached to a lower torso section at the waist. The lower torso section includes two legs and adjustable cuff straps at both ankles. A 360-degree belt surrounds the front of the waist and divides the upper torso section and lower torso section. A two-way tail-to-tail zipper in the front subdivides the upper torso section and extends down below the 360-degree belt and to the crotch area of the lower torso section. In the rear, a lapped two-way head-to-head zipper extends along a seam from below the knees of the lower torso section upward along each leg and converges below the waist, and a two-way head-to-head zipper is centered midway along the seam and openable to release a drop-panel. A wearer can fully open and/or close the drop-panel in one easy motion by zipping/unzipping each side of the double-pull zipper, using both hands to simultaneously pull both zipper-pulls across the waist and down each leg. The combination of a wider and deeper drop-panel that extends past the knees, plus the two-way zipper centered midway along the seam allows easy lavatory access for men and women, and provides better option for women to ensure their comfort and more carefully take care of their feminine sanitary needs.

The present invention is described in greater detail in the detailed description of the invention, and the appended drawings. Additional features and advantages of the invention will be set forth in the description that follows, will be apparent from the description, or may be learned by using the invention.

BRIEF DESCRIPTION OF THE DRAWINGS

Other objects, features, and advantages of the present invention will become more apparent from the following detailed description of the preferred embodiments and certain modifications thereof when taken together with the accompanying drawings.

DETAILED DESCRIPTION OF THE PREFERRED EMBODIMENT

Reference will now be made in detail to preferred embodiments of the present invention, examples of which are illustrated in the accompanying drawings. Wherever possible, the same reference numbers will be used throughout the drawings to refer to the same or like parts.

Figure 1:
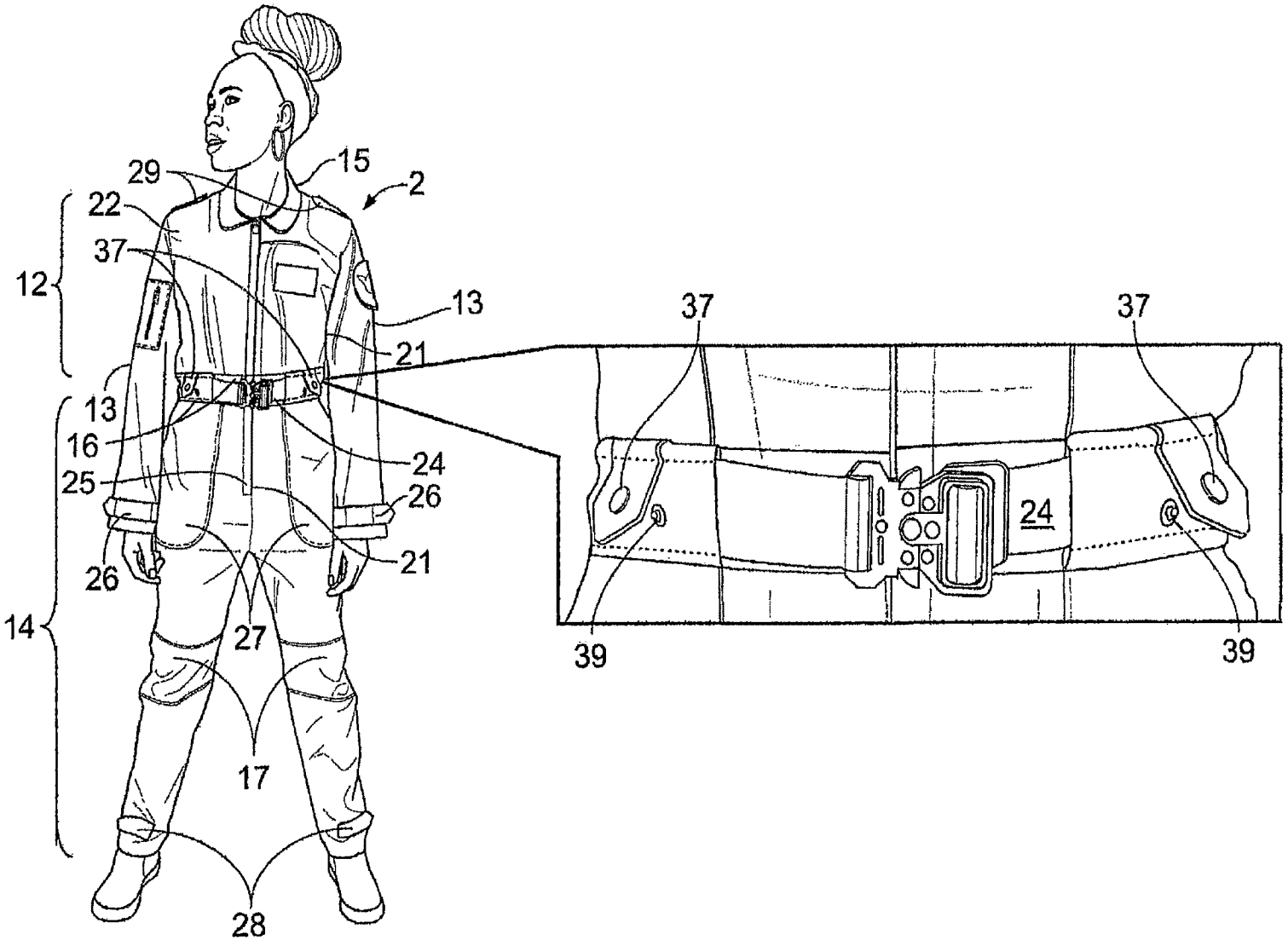
FIG. 1 is a perspective front view of a jumpsuit 2 according to an embodiment of the invention.

As seen in FIG. 1, The present invention is a unitary jumpsuit 2 formed primarily of a stretch blend of fibers that includes elastic fibers, (e.g, 96% Cotton, 4% Elastane—also known as Spandex® or Lycra®) to provide the proper balance of elasticity and tension. The term "jumpsuit" includes all one-piece garments such as coveralls, body suits, flight suits, and overalls.

Figure 2:
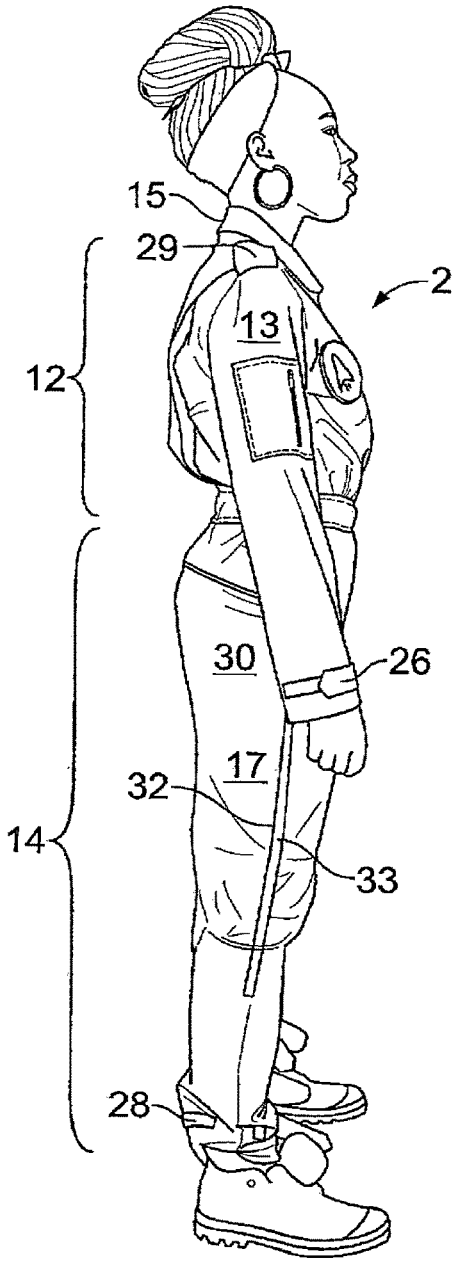
FIG. 2 is a perspective side view of the jumpsuit 2 of FIG. 1.
Figure 3:
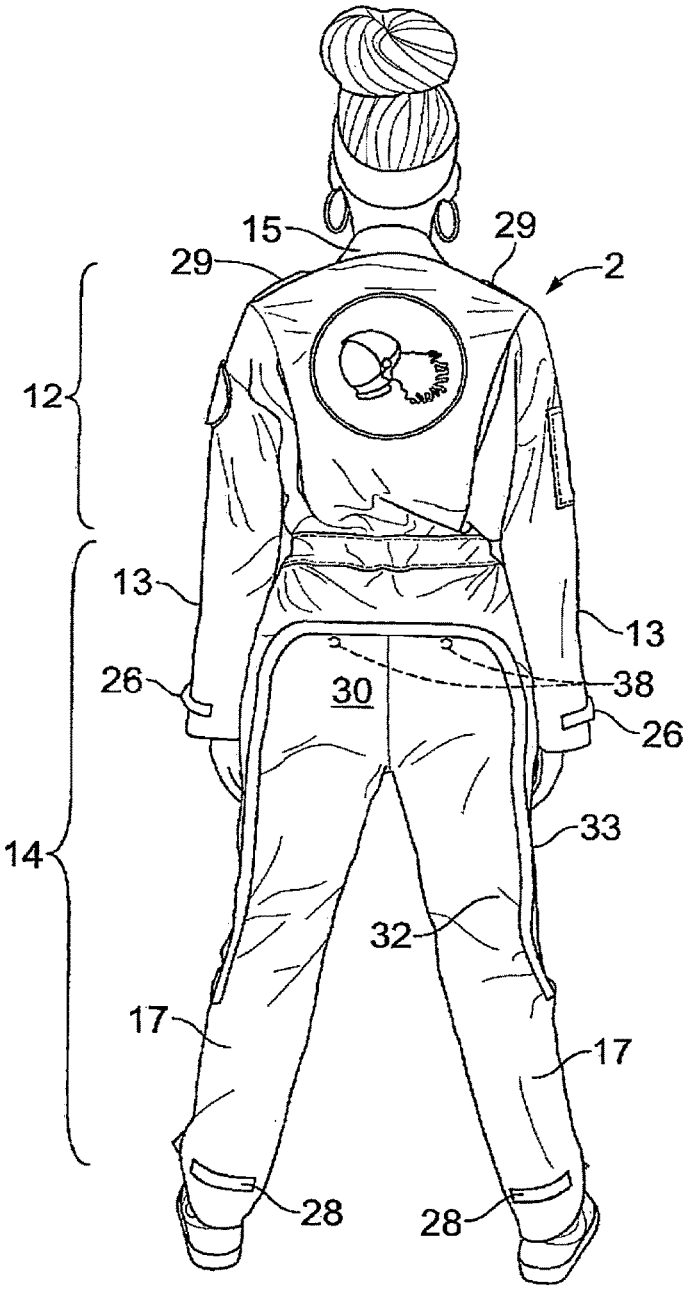
FIG. 3 is a perspective rear view of the jumpsuit 2 of FIGS. 1-2.

As seen collectively in FIGS. 1-3, jumpsuit 2 is form-fitted to the body of the wearer, neither loosely nor tightly fitting, and generally includes an upper torso section 12 and lower torso section 14 joined at the waist 16. The upper torso section 12 includes opposing arms 13 and a collar 15 at the neck. The lower torso section 14 includes two legs 17. Jumpsuit 2 is tightened at the waist 16 by a 360-degree belt 24, and is secured at the ankles, wrists and shoulders by adjustable cuff straps 26, 28, 29, respectively. Jumpsuit 2 may be arrayed with a variety of patches or appliques 22. The wearer gains entry to the jumpsuit 2 by opening a two-way tail-to-tail zipper 21 (e.g., back-to-back) zipper that opens centrally along the top front of the upper torso section 12 from the neck down into the lower torso section 14 to the abdomen, running beneath the belt 24. The zipper 21 is a lapped zipper with topstitch on the outside of the seamline constituting an overhanging flap 25 that hides the zipper 21 and teeth underneath for a clean look. Two elongate pockets 27 are sewn to the hips, open from beneath the belt 24, and run substantially to arm's length as shown.

Figure 4:
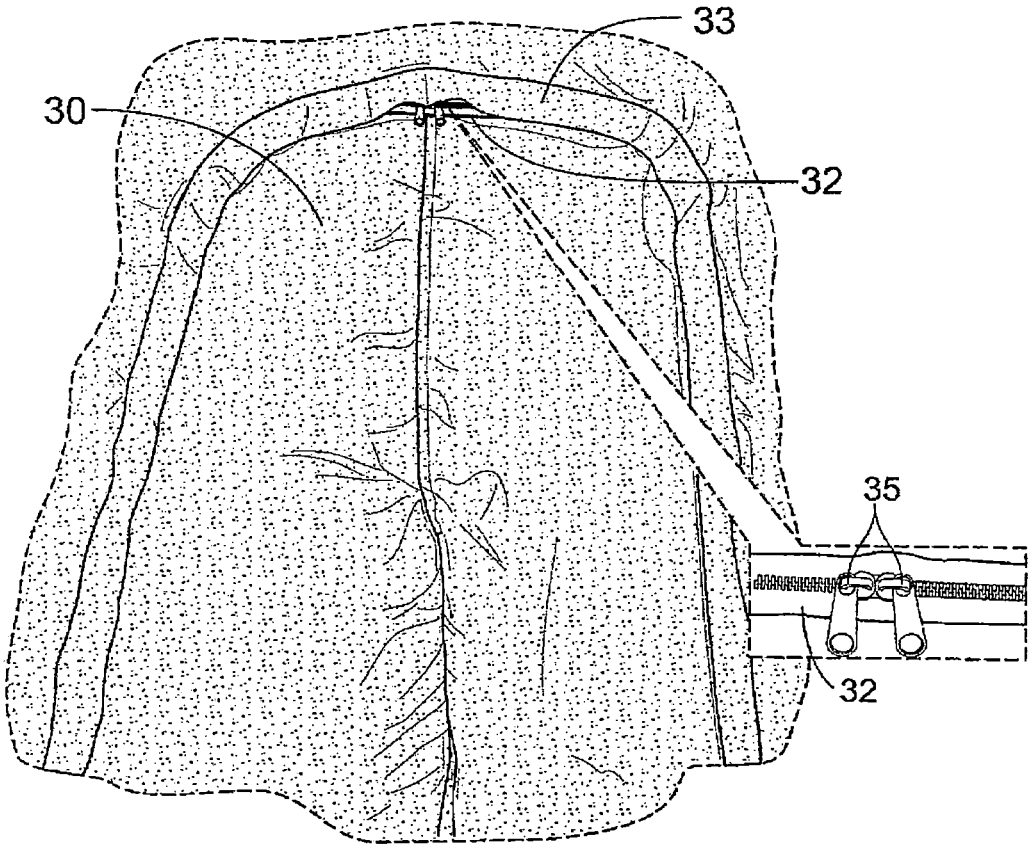
FIG. 4 is a close-up view of the zippered seam 32 with inset showing the lapped two-way zipper.

As seen in FIG. 3, the backside of the jumpsuit 2 includes a lapped zipper seam 32 that runs from below the knees of the lower torso section 14 upward along each leg 17, angling above and around the buttocks in an inverted U-shape, converging laterally across the back within a range of from 2"-6" below the waist 16 and belt 24, optimally approximately 4". The seam 32 defines a drop-panel 30 that extends within a range from 160-180 degrees about the back of the waist, most preferably about 170 degrees. As seen in FIG. 4, the zippered seam 32 is a lapped zipper with topstitch on the outside of the seamline constituting an overhanging flap 33 that hides the zippered seam 32 and zipper/teeth underneath for a clean look. Importantly, as seen in the inset of FIG. 4 the zipper itself is a double-pull zipper 35 with pulls centered at the top center of the seam 32 and inverted U-shaped drop-panel. This way, the wearer can fully open and/or close the drop-panel 30 in one motion using two hands, one each zipping/unzipping each side of the double-pull zipper 35. When zippered seam 32 is fully open, the drop-panel 30 splits away from lower torso section 14 and hangs down from below the knees.

After unzipping the drop-panel 30 falls below knee-height and can be easily gathered by hand, tucked through the legs to the front, pushed out in front of the wearer, and raised to the forward waist. A first pair of fasteners 37 are strategically placed on the outside front of the flight suit 2, and a mating second pair of fasteners 38 (see FIG. 3 dotted lines) on the inside of the U-shaped drop-panel 30 to attach the drop panel 30 the front waistline of the suit 2. The mating second pair of fasteners 38 are located on the inside face of the drop-panel 30 itself, at the top flanking the center. The first pair of fasteners 37 are located on the front of the jumpsuit 2, on the outside flanking the zipper 21 on either side at the waist 16. In the illustrated embodiment, the front-waist fasteners 37 are located on fabric flaps securable to a mating third pair of fasteners 39 located on each opposing belt loop on the front of the suit 2, fasteners 37 comprising female snap button halves, and fasteners 38, 39 comprising female snap button halves, such that the front-waist fasteners 37 can be disengaged from fasteners 39 and released during bathroom use, and the fabric flaps secured instead to the drop seat flap by mating snap-buttons 37, 38, thereby securing the drop seat panel 30 frontally.

Figure 5:
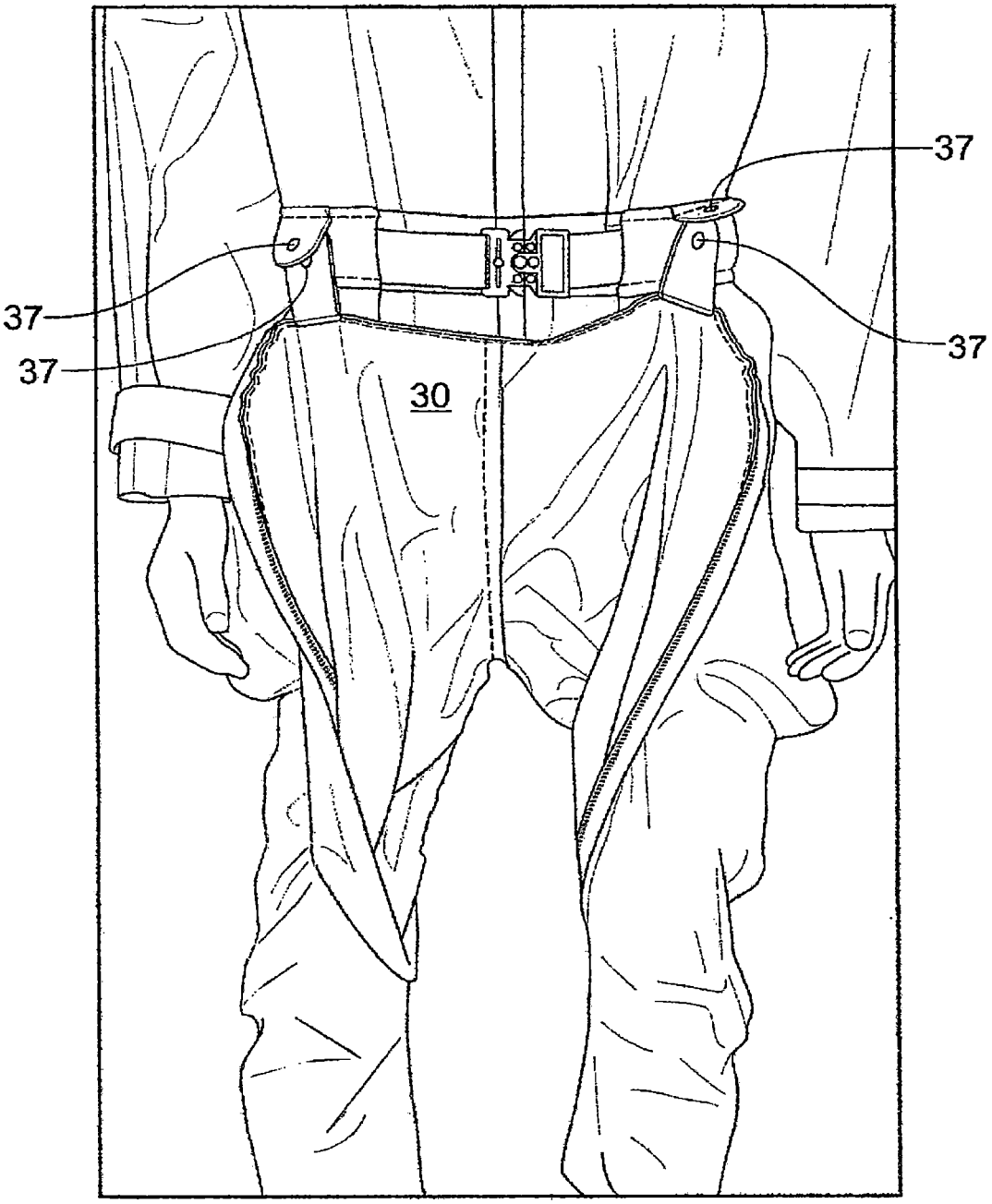
FIG. 5 is a close-up view of the drop-panel 30 pulled up from below the knees and with fasteners 37 attached together to secure it.

As seen in FIG. 5 the drop-panel 30 can be pulled forward and upward between the knees and the pair of fasteners 38 on the drop-panel 30 can now be attached to mating fasteners 37 on the front of the jumpsuit 2. This way fasteners 37, 38 prevent the flap from inadvertently dragging/touching the floor while using the toilet (which is very important when using a public restroom). Although the illustrated fasteners 37, 38, 39 are snap-buttons one skilled in the art should understand that buttons, hook-and-loop fasteners, or any other suitable fasteners can suffice.

Moreover, the two-way tail-to-tail zipper 21 in the front of the jumpsuit 2 can be unzipped down to below the crotch area. This makes it more practical to use for sanitary purposes after toilet usage, especially for women who need to remove and replace tampons and reach their underwear to remove and replace sanitary napkins without making a mess or staining their garment. One skilled in the art should also understand that the preferred embodiment uses two-way tail-to-tail zipper 21 and double-pull zipper 35 with pulls centered at the top center of the seams, but other zipper types are possible, as well as other cuff, ankle and pocket types. For example, tail-to-tail zipper 21 may be replaced by button down access, or eliminated by a rear access opening.

The key here is a wider and deeper drop-panel 30 that extends past the knees, in combination with the dual-zippered closure 33 that zips from the top center of the seam 32, and two-way tail-to-tail zipper 21 on the front of the jumpsuit 2 that extends below the crotch area. This combination of features allows easier access and options for women to be comfortable and carefully take care of all their feminine sanitary needs.

The foregoing disclosure of embodiments of the present invention has been presented for purposes of illustration and description. It is not intended to be exhaustive or to limit the invention to the precise forms disclosed. Many variations and modifications of the embodiments described herein will be obvious to one of ordinary skill in the art in light of the above disclosure. The scope of the invention is to be defined only by the claims, and by their equivalents.

What is claimed is:

1. A unitary jumpsuit comprising a one-piece garment for covering a wearer's torso, inclusive of said wearer's opposing arms, shoulders, wrists, and hips, buttocks, knees, legs, and ankles, comprising:

an upper torso portion including, a pair of opposing arm sections configured to cover said wearer's opposing arms, shoulders and wrists, and a first pair of adjustable cuff straps each attached to and extending along a respective one of said pair of opposing arm sections and configured for securement thereof by wrapping around said wearer's wrists, and a collar;

a lower torso portion including, a buttocks section extending downward from said upper torso portion and configured to cover said wearer's hips and buttocks, a pair of opposing leg sections each including a thigh subsection extending downward from said buttocks section and configured to cover said wearer's thigh, a knee subsection extending downward from said thigh subsection and configured to cover said wearer's knee, a shin subsection extending downward from said knee subsection and configured to cover said wearer's shin, and an ankle subsection extending downward from said shin subsection and configured to cover said wearer's ankle, a second pair of adjustable cuff straps each attached to and extending along a respective one of said ankle subsections and configured for securement thereof by wrapping around said ankle subsections;

a belt circumscribing an intersection of the upper torso section and lower torso section;

a first pair of fasteners attached to the upper torso section above the belt at positions configured to correspond to the wearer's respective hips;

and a closure comprising a lapped seam traversing the lower torso portion and running continuously from endpoints on the respective shin subsections of said lower torso portion and extending laterally upward outside both of said pair of opposing leg sections through the knee subsections and thigh subsections to the buttocks section and converging horizontally across said buttocks section within a range of from 2"-6" below the belt, and a double-pull zipper extending along the seam and openable to release a drop-panel down to the shin subsections of said pair of leg portions;

a second pair of fasteners attached to the drop panel for selective attachment to the first pair of fasteners:

wherein the drop-panel is configured to be fully open and closed by said wearer in one motion using two hands by zipping/unzipping each side of the double-pull zipper with each hand, and wherein the drop-panel is configured to be secured to said front side of the upper torso section by attachment of said first pair of fasteners to said second pair of fasteners.

2. The unitary jumpsuit according to claim 1, wherein said zipper is a two-way double-pull zipper.

* * * * *